US009080468B2

(12) United States Patent
Ozeki

(10) Patent No.: US 9,080,468 B2
(45) Date of Patent: Jul. 14, 2015

(54) CAM HOUSING STRUCTURE FOR THREE-DIMENSIONAL CAM

(71) Applicant: SUZUKI MOTOR CORPORATION, Hamamatsu-shi, Shizuoka (JP)

(72) Inventor: Hisashi Ozeki, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 144 days.

(21) Appl. No.: 13/748,911

(22) Filed: Jan. 24, 2013

(65) Prior Publication Data

US 2013/0192553 A1 Aug. 1, 2013

(30) Foreign Application Priority Data

Jan. 27, 2012 (JP) ..... 2012-015915

(51) Int. Cl.

| | |
|---|---|
| ***F01L 1/02*** | (2006.01) |
| ***F01L 1/053*** | (2006.01) |
| ***F01L 1/344*** | (2006.01) |
| ***F01L 13/00*** | (2006.01) |
| ***F01M 9/10*** | (2006.01) |
| *F01L 1/047* | (2006.01) |

(52) U.S. Cl.

CPC ..... *F01L 1/0532* (2013.01); *F01L 1/34416* (2013.01); *F01L 13/0042* (2013.01); *F01M 9/101* (2013.01); *F01M 9/102* (2013.01); *F01L 2001/0476* (2013.01); *F01L 2001/0537* (2013.01)

(58) Field of Classification Search

CPC . F01L 1/0532; F01L 1/34416; F01L 13/0042; F01L 2001/0476; F01L 2001/0537; F01M 9/102; F01M 9/101

USPC ..... 123/90.27, 90.33–90.34, 90.38, 123/90.15–90.16, 90.31

See application file for complete search history.

(56) References Cited

U.S. PATENT DOCUMENTS

| | | | | | |
|---|---|---|---|---|---|
| 4,505,236 | A | * | 3/1985 | Nakamura | 123/90.27 |
| 5,151,495 | A | * | 9/1992 | Inoue et al. | 528/388 |
| 5,161,495 | A | * | 11/1992 | Saito | 123/90.33 |
| 5,408,958 | A | * | 4/1995 | Esch et al. | 123/90.15 |
| 5,458,099 | A | | 10/1995 | Koller et al. | |
| 5,836,274 | A | * | 11/1998 | Saito et al. | 123/90.16 |

(Continued)

FOREIGN PATENT DOCUMENTS

| | | | | |
|---|---|---|---|---|
| DE | 102004049031 | A1 | | 4/2006 |
| JP | 63297706 | A | * | 12/1988 |

(Continued)

OTHER PUBLICATIONS

Extended European Search Report, dated May 27, 2013, which issued during the prosecution of European Patent Application No. 13152348.2.

*Primary Examiner* — Ching Chang

(74) *Attorney, Agent, or Firm* — Troutman Sanders LLP

(57) ABSTRACT

In a cam housing structure for a three-dimensional cam including: plural intake side supporting parts rotatably supporting an intake side camshaft from above; and plural exhaust side supporting parts rotatably supporting an exhaust side camshaft from above at an upper part of a cylinder head, any one of the supporting parts of the intake side supporting parts or the exhaust side supporting parts is coupled to two or more pieces of the other supporting parts via reinforcing members.

9 Claims, 8 Drawing Sheets

(56) References Cited

U.S. PATENT DOCUMENTS

| | | | | |
|---|---|---|---|---|
| 6,698,400 | B2 * | 3/2004 | Kurtenbach et al. | 123/470 |
| 7,757,646 | B2 * | 7/2010 | Kumagai et al. | 123/90.38 |
| 7,966,982 | B2 * | 6/2011 | Tawarada et al. | 123/90.27 |
| 2002/0185094 | A1 * | 12/2002 | Yoon | 123/90.38 |
| 2004/0118370 | A1 | 6/2004 | Ohsawa | |
| 2004/0139935 | A1 * | 7/2004 | Yamauchi | 123/90.15 |
| 2005/0022766 | A1 * | 2/2005 | Taki | 123/90.18 |
| 2005/0076870 | A1 * | 4/2005 | Nakamura et al. | 123/90.27 |
| 2008/0264366 | A1 * | 10/2008 | Hashimoto | 123/90.17 |
| 2009/0013949 | A1 | 1/2009 | Kumagai et al. | |
| 2011/0041790 | A1 * | 2/2011 | Ilgeroth et al. | 123/90.27 |
| 2013/0192554 | A1 * | 8/2013 | Ozeki | 123/90.34 |

FOREIGN PATENT DOCUMENTS

| | | | |
|---|---|---|---|
| JP | 2011-085051 | A | 4/2011 |
| WO | 2007/083223 | A1 | 7/2007 |

* cited by examiner

CAM HOUSING STRUCTURE FOR THREE-DIMENSIONAL CAM

CROSS-REFERENCE TO RELATED APPLICATIONS

This application is based upon and claims the benefit of priority of the prior Japanese Patent Application No. 2012-015915, filed on Jan. 27, 2012, the entire contents of which are incorporated herein by reference.

BACKGROUND OF THE INVENTION

1. Field of the Invention

The present embodiment relates to a cam housing structure for a three-dimensional cam in which intake side supporting parts rotatably supporting an intake side camshaft from above and exhaust side supporting parts rotatably supporting an exhaust side camshaft from above are provided at upward of a cylinder head.

2. Description of the Related Art

Conventionally, an engine including a valve gear in which plural cylinders are disposed in parallel, a three-dimensional cam provided at a camshaft by each cylinder is slided in an axial direction in accordance with an acceleration opening degree to thereby continuously perform a variable control of a valve lift amount is known in engines of a motorcycle, a motor vehicle, and so on (for example, refer to Patent Document 1).

[Patent Document 1] Japanese Laid-open Patent Publication No. 2011-85051

In the valve gear including the three-dimensional cam as stated above, the three-dimensional cam slides on the camshaft, and therefore, it is necessary to enough increase stiffness and strength of a cam housing supporting the camshaft. However, there is a problem in which it is difficult to enough satisfy these requirements in the engine including the conventional valve gear.

Besides, there also is a problem in which it is difficult to secure paths to supply lubricant oil for the camshaft supporting the three-dimensional cam and a mechanism to drive the three-dimensional cam.

SUMMARY OF THE INVENTION

The present invention was made to solve the above-described problems and has an object to provide a cam housing structure for a three-dimensional cam capable of enough increasing stiffness and strength of the cam housing and easily supplying lubricant oil for a camshaft and a cam driving mechanism.

To attain the above-stated object, the present embodiment is characterized in that a cam housing structure for a three-dimensional cam, includes: plural intake side supporting parts rotatably supporting an intake side camshaft from above; and plural exhaust side supporting parts rotatably supporting an exhaust side camshaft from above at an upper part of a cylinder head, wherein any one of the supporting parts of the intake side supporting parts or the exhaust side supporting parts is coupled to two or more pieces of the other supporting parts via reinforcing members.

According to this characteristic, it is possible to enough increase stiffness and strength for a force acting in a tilting direction of the intake side supporting parts and the exhaust side supporting parts toward the intake side camshaft side or the exhaust side camshaft side.

Besides, the cam housing structure for the three-dimensional cam according to the present embodiment is characterized in that the one supporting part is disposed between two pieces of the other supporting parts in an axial direction of the camshaft, and is coupled to each of the two pieces of the other supporting parts via the reinforcing members.

According to this characteristic, the reinforcing members are formed in an inverted V-state or a V-state, and therefore, it is possible to further increase the stiffness and strength.

Besides, the cam housing structure for the three-dimensional cam according to the present embodiment is characterized in that bearing parts rotatably supporting a fork shaft having cam forks sliding and driving the three-dimensional cams along the intake side camshaft are provided at upward of the intake side supporting part.

According to this characteristic, a height becomes higher by providing the bearing part at upward of the intake side supporting part, and therefore, a moment generated by forces in the camshaft direction, the longitudinal direction, or the rotational direction acting on the bearing parts becomes large, but it is possible to secure stiffness and strength capable of enough staying with the moment.

The cam housing structure for the three-dimensional cam according to the present embodiment is characterized in that an intake side cam housing mutually and integrally coupling the plural intake side supporting parts is included.

According to this characteristic, it is possible to further increase the stiffness and strength because it is possible to receive a force acted in a tilting direction toward the intake side camshaft side of the intake side supporting parts by the intake side cam housing mutually and integrally coupling the plural intake side supporting parts.

Besides, the cam housing structure for the three-dimensional cam according to the present embodiment is characterized in that an exhaust side cam housing mutually and integrally coupling the plural exhaust side supporting parts is included.

According to this characteristic, it is possible to further increase the stiffness and strength because it is possible to receive a force acted in a tilting direction toward the exhaust side camshaft side of the exhaust side supporting parts by the exhaust side cam housing mutually and integrally coupling the plural exhaust side supporting parts.

The cam housing structure for the three-dimensional cam according to the present embodiment is characterized in that an opening part is formed at the intake side cam housing in a sliding range of the cam fork.

According to this characteristic, it is disadvantageous in the stiffness and strength as it is because the opening part is formed at the intake side cam housing. However, it is possible to enough secure the stiffness and strength for a force acted in a tilting direction of the intake side supporting parts and the exhaust side supporting parts toward the intake side camshaft side or the exhaust side camshaft side.

The cam housing structure for the three-dimensional cam according to the present embodiment is characterized in that the intake side cam housing mutually and integrally coupling the plural intake side supporting parts and the exhaust side cam housing mutually and integrally coupling the plural exhaust side supporting parts are coupled with each other via coupling members, oil passages are each formed at an inner part of the intake side cam housing and an inner part of the exhaust side cam housing, and oil communication passages communicating the oil passages of the intake side cam housing with the oil passage of the exhaust side cam housing are formed at inner parts of the coupling members.

According to this characteristic, it is possible to further increase the stiffness and strength of the cam housing by forming the oil communication passage at the coupling member.

Besides, the cam housing structure for the three-dimensional cam according to the present embodiment is characterized in that an oil supply ring is provided between the intake side camshaft and the intake side supporting part, an oil path constituting a part of the oil passage at the inner part of the intake side cam housing is formed between an outer peripheral surface of the oil supply ring and an inner peripheral surface of the intake side supporting part, and the oil passages are communicated with the bearing parts rotatably supporting the fork shaft formed at upward of the intake side supporting parts.

According to this characteristic, it is possible to easily manufacture the oil passages reaching the bearing parts rotatably supporting the fork shaft formed at upward of the intake side supporting parts without damaging the stiffness and strength of the intake side cam housing because it is not necessary to process the oil passage at the intake side cam housing by using a drill and so on, and it is possible to form the oil passage as short as possible.

Besides, the cam housing structure for the three-dimensional cam according to the present embodiment is characterized in that oil holes heading from the oil path to the inner part of the camshaft are formed at the oil supply ring and the camshaft in a radial direction.

According to this characteristic, it is possible to easily and surely perform not only the supply of oil for the fork shaft but also the supply of oil for the camshaft.

Besides, the cam housing structure for the three-dimensional cam according to the present embodiment is characterized in that the oil path is formed by cutting out an outer peripheral part of the oil supply ring in an arc shape.

According to this characteristic, it is possible to make a flow of the oil heading for the fork shaft smooth by forming the oil path in the arc shape.

DETAILED DESCRIPTION OF THE PREFERRED EMBODIMENTS

Figure 1:
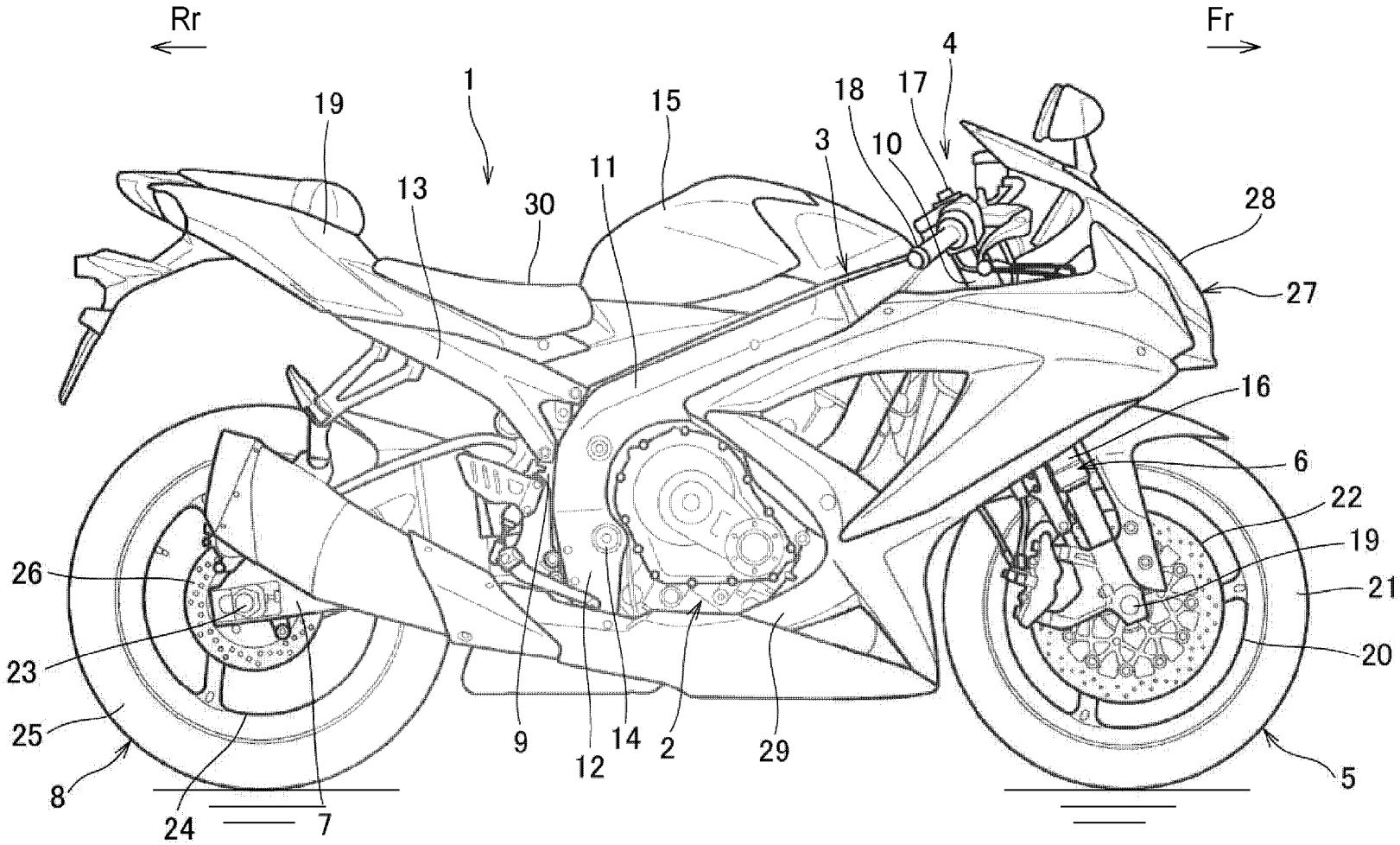
FIG. 1 is a right side view illustrating a motorcycle having a cam housing structure for a three-dimensional cam according to the present embodiment.

Hereinafter, a cam housing structure for a three-dimensional cam according to the present embodiment will be described in detail with reference to the drawings. Note that the cam housing structure for the three-dimensional cam according to the present embodiment can be effectively applied for various vehicles including gasoline engine mounted on a motorcycle or a four-wheeled vehicle, but a case when it is applied for an engine 2 of a motorcycle 1 as illustrated in FIG. 1 is exemplified and explained in the following description of the present embodiment. Besides, in the following description, directions of forward and backward, right and left and upward and downward are respectively indicated by an arrow Fr for the forward of the vehicle, an arrow Rr for the backward of the vehicle, and an arrow R for a lateral right side of the vehicle, and an arrow L for a lateral left side of the vehicle while setting a direction seen from a rider riding on the motorcycle 1 as a reference.

FIG. 1 is a right side view illustrating the motorcycle 1 having the cam housing structure for the three-dimensional cam according to the present embodiment. The motorcycle 1 is constituted by including a, vehicle body frame 3, the engine 2 mounted on the vehicle body frame 3, a steering mechanism 4 pivotally supported at a front end part of the vehicle body frame 3, a front wheel 5 pivotally supported at a lower end part of the steering mechanism 4, a front wheel suspension system 6 provided at the steering mechanism 4, a swing arm 7 pivotally supported to be capable of swinging in a longitudinal direction at a rear part of the vehicle body frame 3, a rear wheel 8 rotatably supported at a rear end part of the swing arm 7, and a rear wheel suspension system 9 coupled between the vehicle body frame 3 and the swing arm 7.

The vehicle body frame 3 is, for example, a twin tube type, and it is constituted by including a head pipe 10 disposed at a front end part, a left and right pair of main frames 11 double as a tank rail widened in right and left directions just behind the head pipe 10 and extending diagonally backward and downward, a left and right pair of center frames 12 integrally provided at a rear end part of the main frames 11 and extending approximately downward, and a left and right pair of seat rails 13 extending diagonally backward and upward from the rear end part of the main frames 11.

The head pipe 10 pivotally supports the steering mechanism 4 via a steering shaft (not-illustrated). Besides, the center frames 12 support a pivot shaft 14 which is built at approximately a center part in a longitudinal direction, and the pivot shaft 14 pivotally supports the swing arm 7. Further, the main frames 11 and the seat rails 13 support a fuel tank 15 from below.

The engine 2 is disposed at a central lower part of the motorcycle 1, in more detail, it is disposed at downward of the main frames 11. Note that a constitution of the engine 2 will be described later.

The steering mechanism 4 is rotatably supported by the head pipe 10 and the steering shaft to be rotatable in a right and left direction of the motorcycle 1. The steering mechanism 4 includes a left and right pair of front forks 16 provided at a steering head rotatably supported by the steering shaft and a pair of handle bars 17 provided in a vicinity of an upper end of the front forks 16 or at the steering head. Each of the right and left handle bars 17 includes a handle grip 18, and the handle grip 18 disposed at a right side is a throttle grip.

The front wheel 5 is steered by the handle bars 17 of the steering mechanism 4 to be rotatable to right and left, and constituted by including a front wheel wheel 20 pivotally supported to the front fork 16 by a front wheel axle 19, a front wheel tire 21 deposited at an outer peripheral part of the front wheel wheel 20, and a front wheel brake plate 22 fixed to the front wheel wheel 20 by a fastening member (not-illustrated) such as a bolt.

A front end part of the swing arm 7 is pivotally supported by the pivot shaft 14 provided at approximately a center in a longitudinal direction of the center frame 12.

The rear wheel 8 is constituted by including a rear wheel wheel 24 rotatably supported to the swing arm 7 by a rear wheel axle 23, a rear wheel tire 25 deposited at an outer peripheral part of the rear wheel wheel 24, and a rear wheel brake plate 26 fixed to the rear wheel wheel 24 by a fastening member (not-illustrated) such as a bolt.

The rear wheel suspension system 9 is a bumper so as not to transmit a swing in the longitudinal direction of the swing arm 7 caused by concave and convex of a road surface captured by the rear wheel 8 to the vehicle body frame 3, doubles a function to hold down the rear wheel 8 to the road surface, and includes a suspension unit in which a spring and a shock absorber are combined (any of them are not-illustrated).

Besides, at least a part of the vehicle of the motorcycle 1, for example, a part from a front part to a central lower part is covered with a streamline type cowling 27. This cowling 27 is formed to reduce an air resistance during driving of the motorcycle 1 and to protect a rider from a driving wind pressure. The cowling 27 includes a front cover 28 covering the front part of the vehicle and a seat cowl 29 covering a rear part of the vehicle, and the seat cowl 29 supports a seating seat 30.

Next, the engine 2 having the cam housing structure for the three-dimensional cam according to the present embodiment is described in detail.

Figure 2:
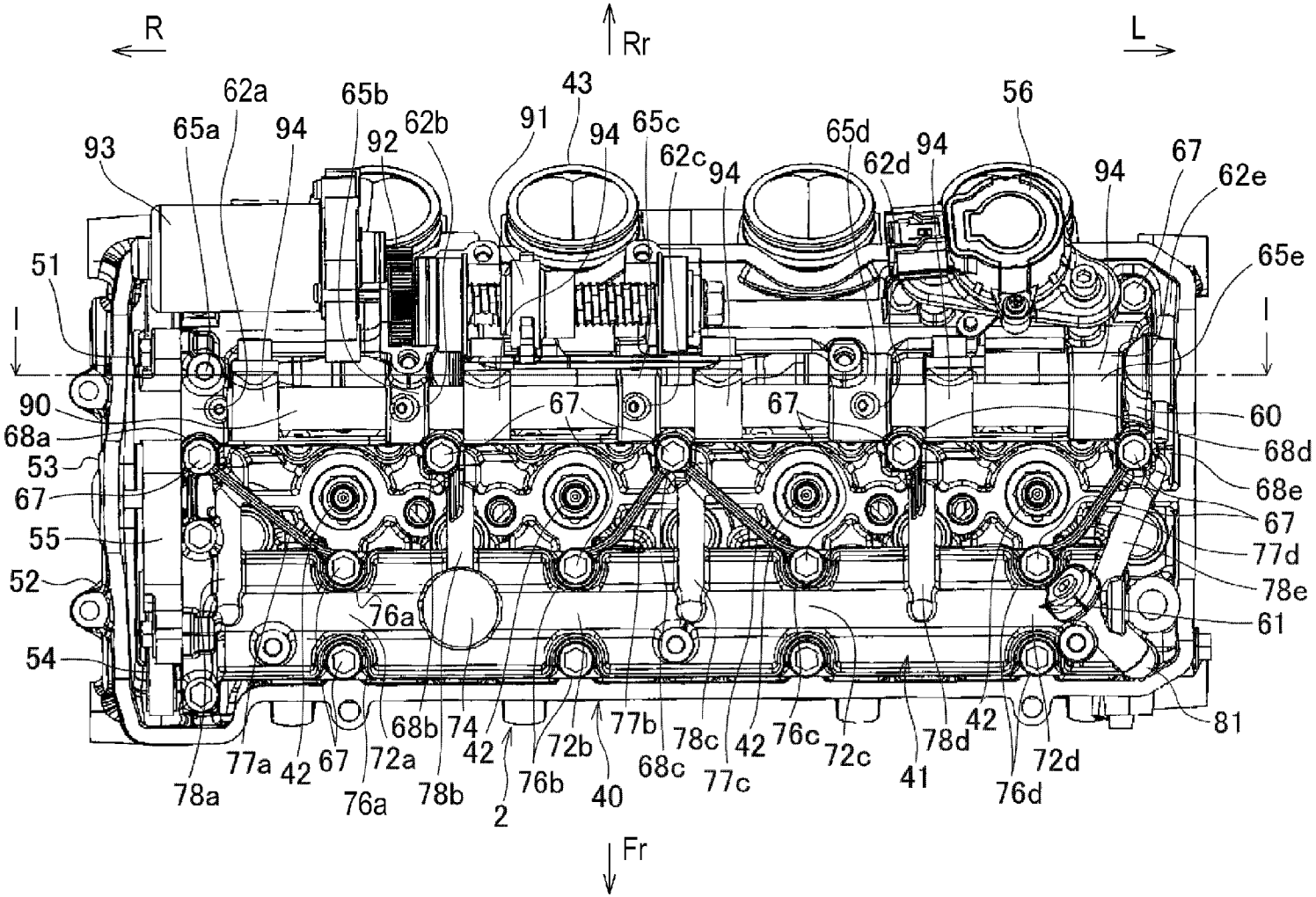
FIG. 2 is a plan view illustrating an engine having the cam housing structure for the three-dimensional cam according to the present embodiment.
Figure 3:
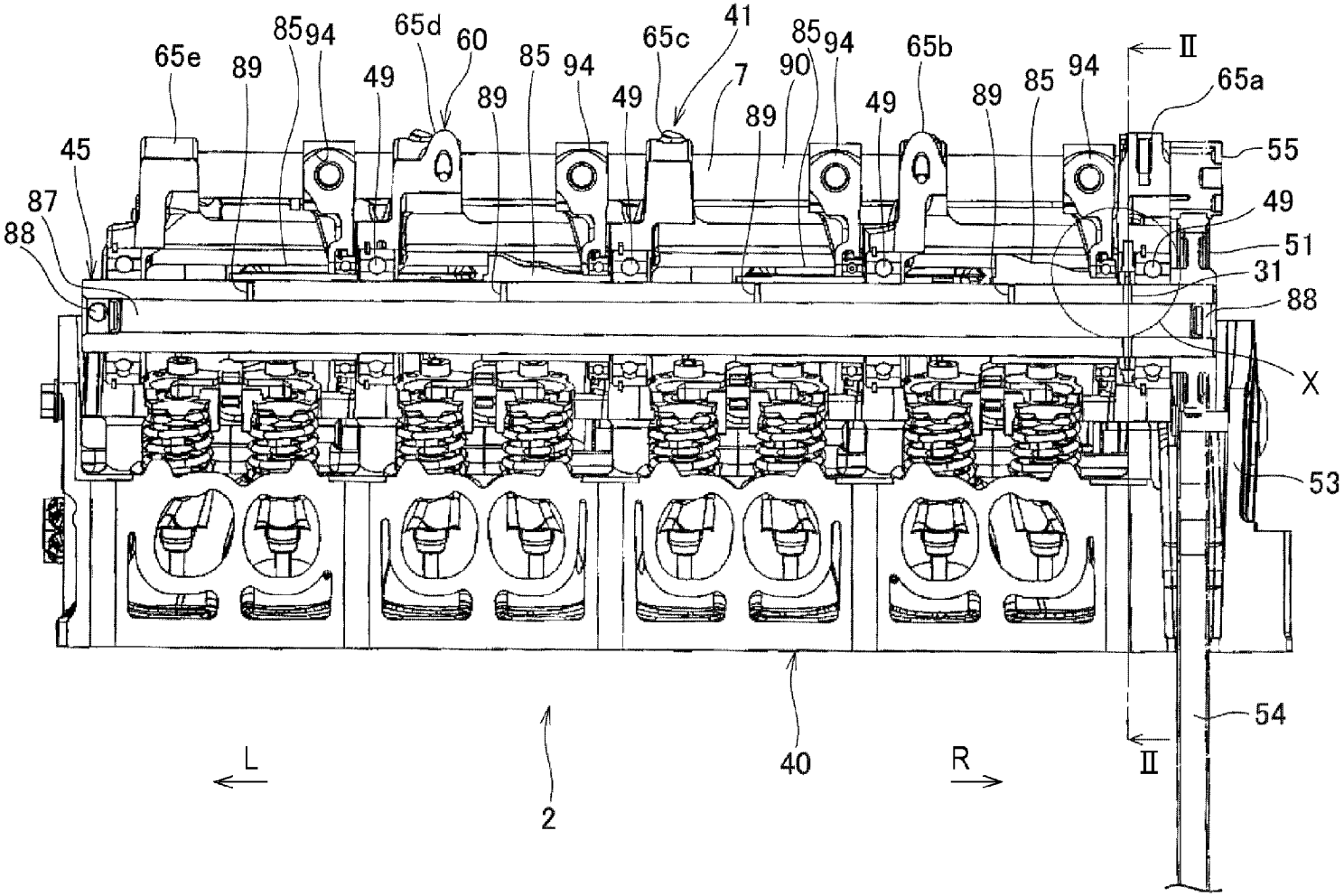
FIG. 3 is a sectional view along a I-I line in FIG. 2.
Figure 4:
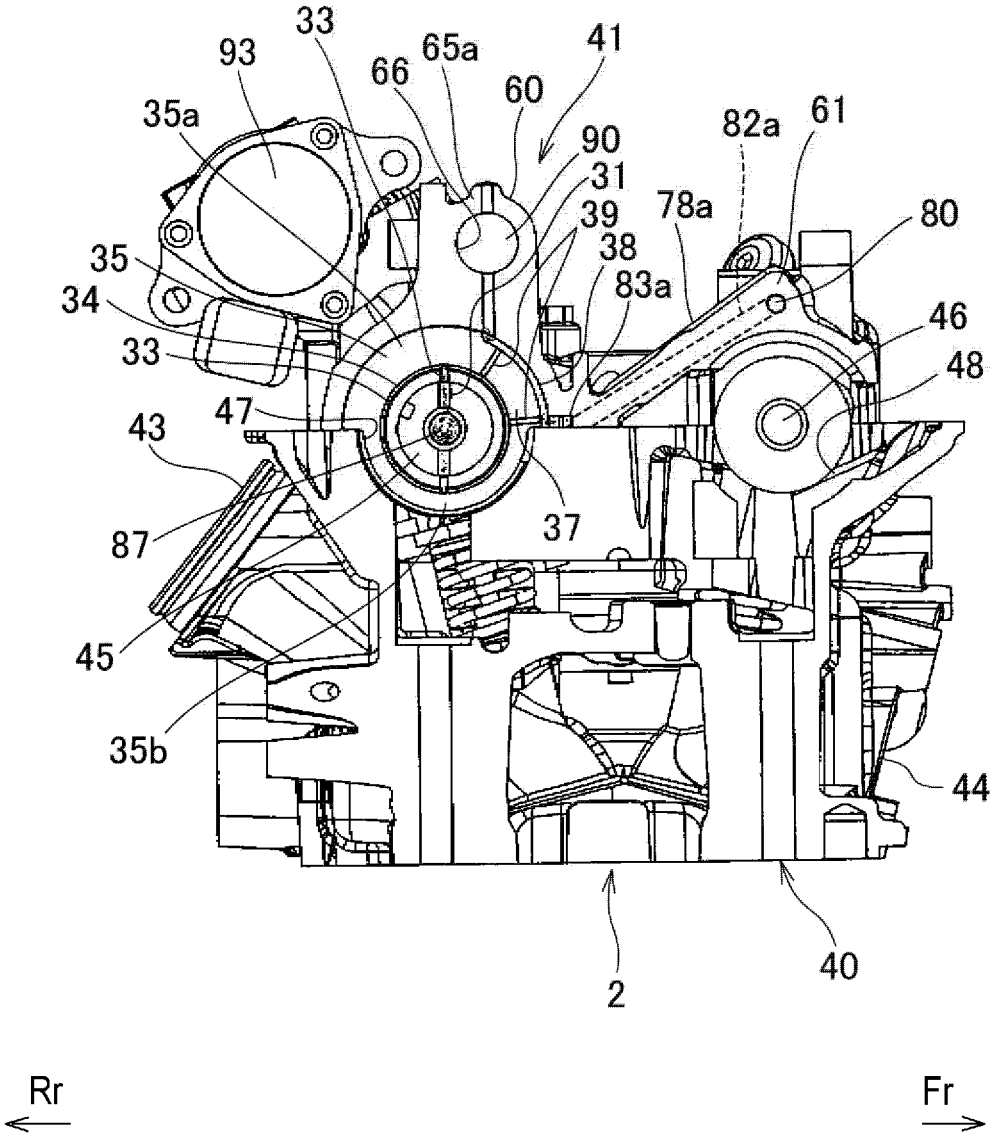
FIG. 4 is a sectional view along a II-II line in FIG. 3.
Figure 5:
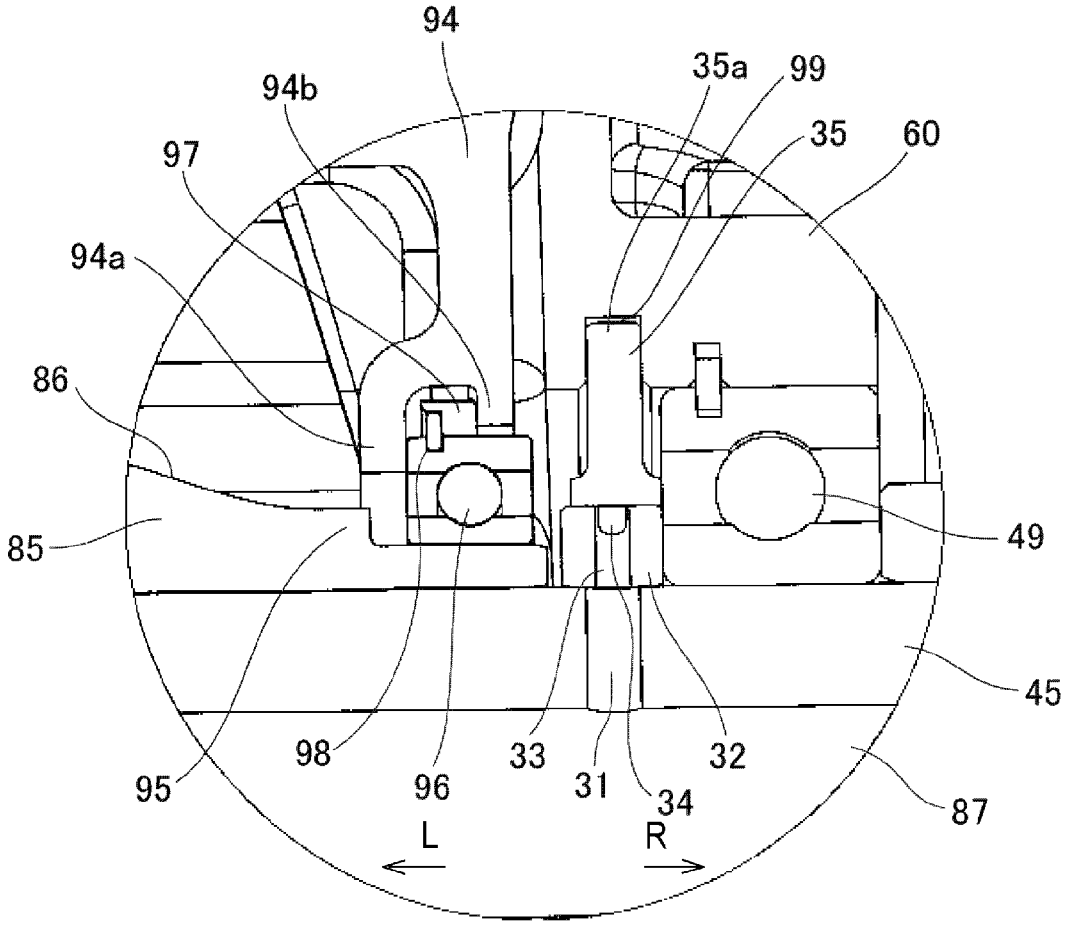
FIG. 5 is an enlarged view of an X part in FIG. 3.
Figure 6:
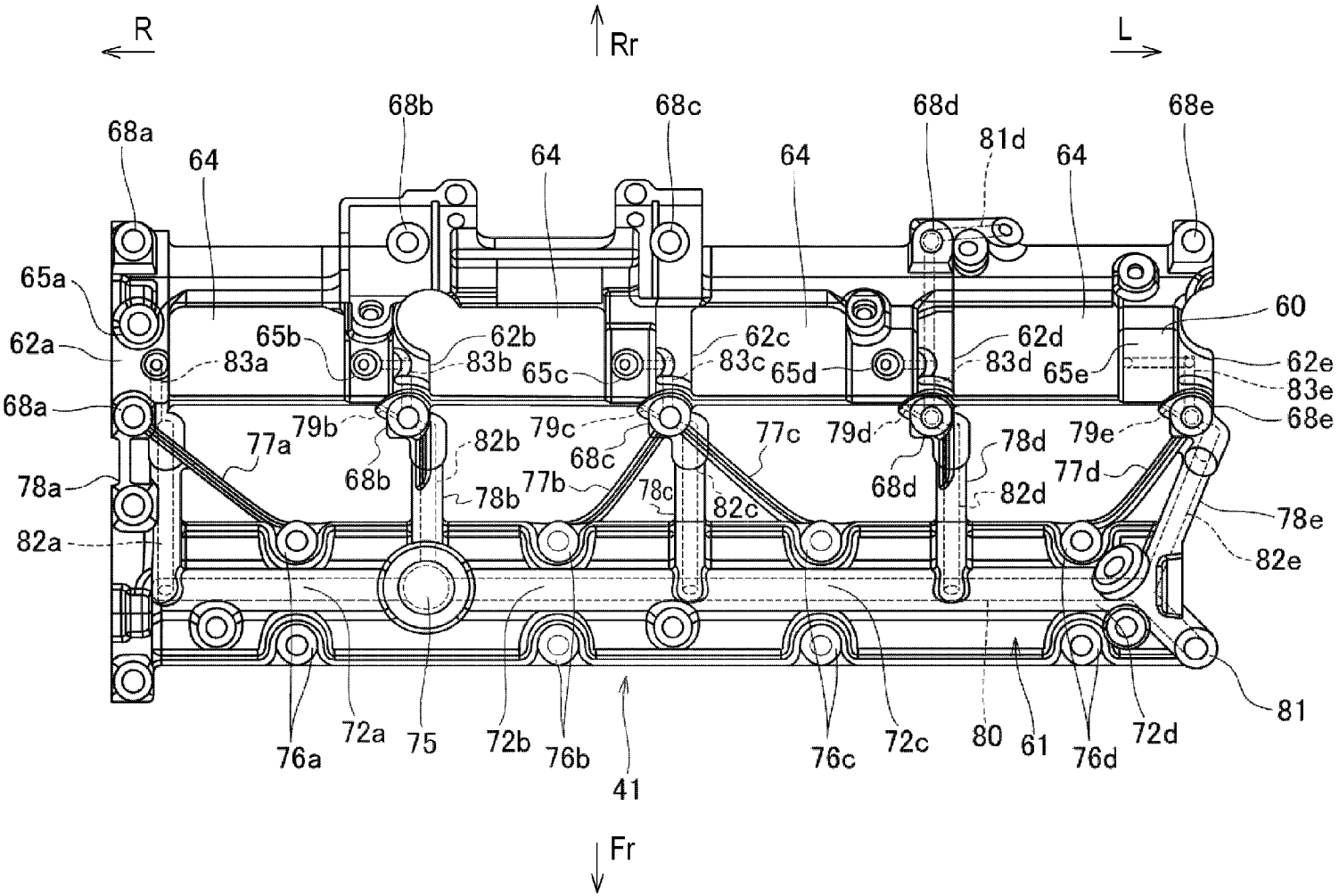
FIG. 6 is a plan view illustrating the cam housing structure for the three-dimensional cam according to the present embodiment.
Figure 7:
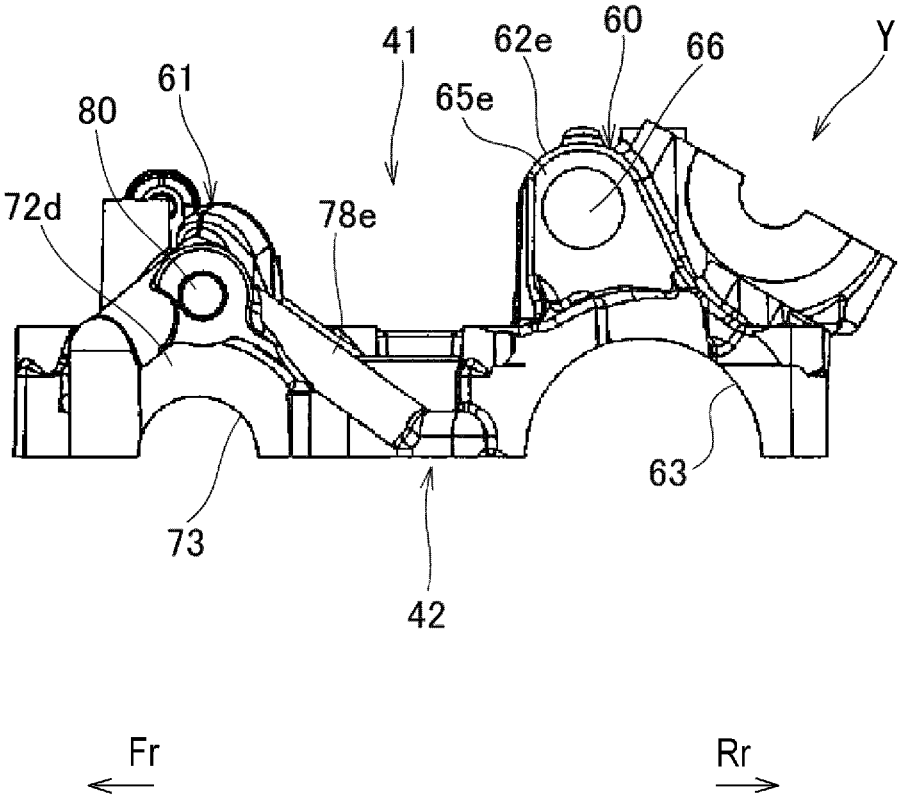
FIG. 7 is a side view illustrating the cam housing structure for the three-dimensional cam according to the present embodiment.
Figure 8:
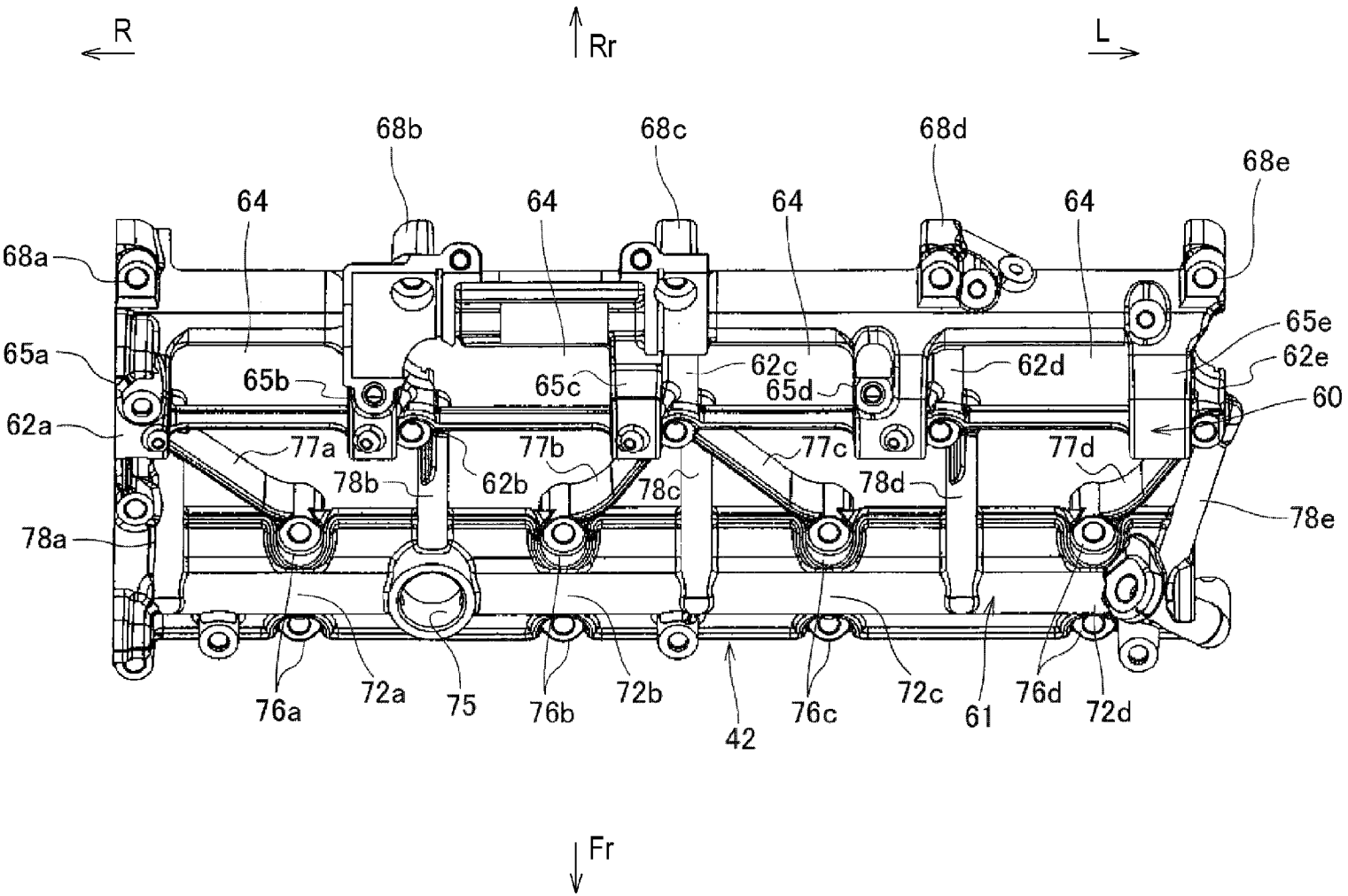
FIG. 8 is a perspective view seen from a Y arrow direction in FIG. 7.

FIG. 2 is a plan view illustrating the engine 2 under a state in which a head cover and a ball screw cover are detached, FIG. 3 is a I-I sectional view of FIG. 2, FIG. 4 is a II-II sectional view of FIG. 3, FIG. 5 is an enlarged view of an X part in FIG. 3, FIG. 6 is a plan view illustrating the cam housing structure for the three-dimensional cam, FIG. 7 is a side view illustrating the cam housing structure for the three-dimensional cam, and FIG. 8 is a perspective view seen from a Y arrow direction of FIG. 7. Hereinafter, these views are appropriately referred to.

The engine 2 is, for example, a four-cylinder engine, and constituted by including a cylinder head 40 arranged at an upper surface of a not-illustrated cylinder block toward approximately upward, a cam housing 41 provided at an upper part of the cylinder head 40, and a head cover (not-illustrated) covering at an upper side of the cylinder head 40 and the cam housing 41.

Four spark plugs 42 are arranged at the cylinder head 40 at regular intervals in a vehicle body right and left direction at approximately a center part in a width direction of the cylinder head 40, namely in a forward and backward direction of the vehicle body, an intake port 43 is opened toward diagonally upward at the rear side of the vehicle body, and an exhaust port 44 is opened toward diagonally downward at the front side of the vehicle body sandwiching these spark plugs 42.

Besides, plural intake side camshaft receiving parts 47 and exhaust side camshaft receiving parts 48 each in a lower semicircular shape are arranged in a zigzag state sandwiching the spark plugs 42 at an upper part of the cylinder head 40, and an intake side camshaft 45 and an exhaust side camshaft 46 are rotatably supported on the intake side camshaft receiving parts 47 and the exhaust side camshaft receiving parts 48 to be in parallel with each other.

An intake side sprocket 51 is integrally and rotatably attached at one end part (a right end part in the embodiment) of the intake side camshaft 45, and an exhaust side sprocket 52 is integrally and rotatably attached at one end part of the exhaust side camshaft 46. The intake side camshaft 45 and the exhaust side camshaft 46 are constituted to be rotationally driven by being spread over by a timing chain 54 covered with a chain case 53, and the timing chain 54 is to be driven properly by a timing chain guide 55 arranged at upward of the timing chain 54. Besides, a cam position sensor 56 detecting a rotation of the intake side cam sprocket 51 is attached at the cylinder head 40.

The cam housing 41 includes an intake side cam housing 60 formed at upward of the intake side camshaft 45 supported by the cylinder head 40 and an exhaust side cam housing 61 formed at upward of the exhaust side camshaft 46 supported by the cylinder head 40.

First to fifth intake side supporting parts 62*a*, 62*b*, 62*c*, 62*d* and 62*e* are each formed at the intake side cam housing 60 at positions corresponding to the intake side camshaft receiving parts 47 of the cylinder head 40 from the above-stated one end part toward the other end part (a left side in the embodiment) in sequence. The respective intake side supporting parts 62*a*, 62*b*, 62*c*, 62*d* and 62*e* are mutually and integrally coupled, and openings 64 are each formed between each of the intake side supporting parts 62*a*, 62*b*, 62*c*, 62*d* and 62*e* in accordance with sliding ranges of a later-described cam fork 94.

A downward concave part 63 (FIG. 7) in an upper semicircular shape is formed at each of the intake side supporting parts 62*a*, 62*b*, 62*c*, 62*d* and 62*e* so as to be able to rotatably support the intake side camshaft 45 from above, and the intake side camshaft 45 is rotatably supported by bearings 49 attached along the downward concave parts 63 and the intake side camshaft receiving parts 47 (FIG. 4).

Bearing parts 65*a*, 65*b*, 65*c*, 65*d* and 65*e* are respectively formed at upper parts of the intake side supporting parts 62*a*, 62*b*, 62*c*, 62*d* and 62*e*, and a columnar-shaped bearing hole 66 (refer to FIG. 4) is formed at each of the bearing parts 65*a*, 65*b*, 65*c*, 65*d* and 65*e*. A fork shaft 90 is supported to be slidable in an axial direction at each bearing hole 66, and a motor 93, a ball screw 91, a gear group 92, and so on constituting a driving mechanism of the fork shaft 90 are attached at an upper part of the intake side cam housing 60 at an opposite position (namely, at the rear side of the vehicle body) of the fork shaft 90 sandwiching the intake side camshaft 45 in a plan view as illustrated in FIG. 2. The fork shaft 90 is connected to an output shaft of the motor 93 via the ball screw 91 and the gear group 92, and the fork shaft 90 thereby makes a sliding move for a desired amount by operation of the motor 93 in an axial direction thereof.

Intake side fixing parts 68*a*, 68*b*, 68*c*, 68*d* and 68*e* capable of screwing and inserting bolts 67 to fix the intake side cam housing 60 at the cylinder head 40 are each formed at a front end part and a rear end part of the respective intake side supporting parts 62*a*, 62*b*, 62*c*, 62*d* and 62*e*.

On the other hand, first to fourth exhaust side supporting parts 72*a*, 72*b*, 72*c* and 72*d* are each formed at the exhaust side cam housing 61 at positions corresponding to the exhaust side camshaft receiving parts 48 of the cylinder head 40 from the one end part toward the other end part in sequence. Each of the exhaust side supporting parts 72*a*, 72*b*, 72*c* and 72*d* are mutually and integrally coupled, and an engaging concave part 75 for a columnar-shaped oil plug 74 is formed between the first exhaust side supporting part 72*a* and the second exhaust side supporting part 72*b* at the one end part side.

A downward concave part 73 (FIG. 7) in an upper semicircular shape is formed at each of the exhaust side supporting parts 72*a*, 72*b*, 72*c* and 72*d* so as to be able to rotatably support the exhaust side camshaft 46 from above, and the exhaust side camshaft 46 is rotatably supported by bearings (not-illustrated) attached along the downward concave parts 73 and the exhaust side camshaft receiving parts 48.

Exhaust side fixing parts 76*a*, 76*b*, 76*c* and 76*d* capable of screwing and inserting bolts 67 to fix the exhaust side cam housing 61 at the cylinder head 40 are each formed at a front end part and a rear end part of the respective exhaust side supporting parts 72*a*, 72*b*, 72*c* and 72*d*.

The exhaust side fixing part 76*a* at the rear end part of the first exhaust side supporting part 72*a* is coupled to the intake side fixing part 68*a* at the front end part of the first intake side supporting part 62*a* by a first reinforcing member 77*a* in a rib state. The first reinforcing member 77*a* is stretched over between the intake side fixing part 68*a* and the exhaust side fixing part 76*a* in a diagonal direction in a plan view as illustrated in FIG. 2.

The exhaust side fixing part 76*b* at the rear end part of the second exhaust side supporting part 72*b* is coupled to the intake side fixing part 68*c* at the front end part of the third intake side supporting part 62*c* by a second reinforcing member 77*b* in the rib state, and the exhaust side fixing part 76*c* at the rear end part of the third exhaust side supporting part 72*c* is coupled to the intake side fixing part 68*c* at the front end part of the third intake side supporting part 62*c* by a third reinforcing member 77*c* in the rib state. Namely, the second reinforcing member 77*b* is stretched over between the intake side fixing part 68*c* and the exhaust side fixing part 76*b* in an opposite side diagonal direction of the first reinforcing member 77*a* in a plan view as illustrated in FIG. 2, the third reinforcing member 77*c* is stretched over between the intake side fixing part 68*c* and the exhaust side fixing part 76*c* in the same side diagonal direction as the first reinforcing member 77*a* in a plan view, and the second reinforcing member 77*b* and the third reinforcing member 77*c* are disposed to form an inverted V-state.

The third intake side supporting part 62*c* is thereby disposed between the second exhaust side supporting part 72*b* and the third exhaust side supporting part 72*c* in an axial direction of the camshafts 45, 46, and coupled to two pieces of the exhaust side supporting parts of the second exhaust side supporting part 72*b* and the third exhaust side supporting part 72*c* via the second reinforcing member 77*b* and the third reinforcing member 77*c*. Accordingly, it is possible to enough increase stiffness and strength of the cam housing 41.

The exhaust side fixing part 76*d* at the rear end part of the fourth exhaust side supporting part 72*d* is coupled to the intake side fixing part 68*e* at the front end part of the fifth intake side supporting part 62*e* by a fourth reinforcing member 77*d* in the rib state, and the fourth reinforcing member 77*d* is stretched over between the intake side fixing part 68*e* and the exhaust side fixing part 76*d* in an opposite side diagonal direction from the first reinforcing member 77*a* in a plan view as illustrated in FIG. 2.

Besides, the first to fourth reinforcing members 77*a*, 77*b*, 77*c* and 77*d* are formed to extend to a height of a bearing surface of the bolt 67 of any one of the fixing parts of the intake side fixing parts 68*a*, 68*c* and 68*e* or the exhaust side fixing parts 76*a*, 76*b*, 76*c* and 76*d*.

The intake side cam housing 60 and the exhaust side cam housing 61 are coupled with each other by first to fifth coupling members 78*a*, 78*b*, 78*c*, 78*d* and 78*e* from the above-stated one end part side toward the other end part in sequence.

The first to fifth coupling members 78*a*, 78*b*, 78*c*, 78*d* and 78*e* are formed to incline downward from an upper part of the exhaust side cam housing 61 toward the intake side cam housing 60, and ribs are provided. The first coupling member 78*a* couples respective one end parts of the intake side cam housing 60 and the exhaust side cam housing 61 with each other. Besides, the second coupling member 78*b* couples the intake side fixing part 68*b* at the front end part of the second intake side supporting part 62*b* and the engaging concave part 75. Further, the third coupling member 78*c* couples the intake side fixing part 68*c* at the front end part of the third intake side supporting part 62*c* and a part between the second exhaust side supporting part 72*b* and the third exhaust side supporting part 72*c* of the exhaust side cam housing 61. Further, the fourth coupling member 78*d* couples the intake side fixing part 68*d* at the front end part of the fourth intake side supporting part 62*d* and a part between the third exhaust side supporting part 72*c* and the fourth exhaust side supporting part 72*d* of the exhaust side cam housing 61, and further, the fifth coupling member 78*e* couples the respective other end parts of the intake side cam housing 60 and the exhaust side cam housing 61 with each other.

A main oil passage 80 is formed in a linear state in a right and left direction at a central inner part of the exhaust side cam housing 61, and an inlet part 81 of oil from the cylinder head 40 is provided at the other end part of the main oil passage 80 as illustrated in FIG. 6.

Oil communication passages 82*a*, 82*c*, 82*d* and 82*e* directly communicated with the main oil passage 80 are each formed at inner parts of the first coupling member 78*a* and the third to fifth coupling members 78*c*, 78*d* and 78*e* as illustrated in FIG. 6. Besides, an oil communication passage 82*b* communicated with the main oil passage 80 via an oil groove (not-illustrated) formed at an outer peripheral surface of the oil plug 74 (refer to FIG. 2) engaged with the engaging concave part 75 is formed at an inner part of the second coupling member 78*b*.

Oil passages 83*a*, 83*b*, 83*c*, 83*d* and 83*e* are formed at inner parts of the first to fifth intake side supporting parts 62*a*, 62*b*, 62*c*, 62*d* and 62*e* of the intake side cam housing 60 so as to be respectively communicated with the oil communication passages 82*a*, 82*b*, 82*c*, 82*d* and 82*e*. The oil passages 83*a*, 83*b*, 83*c*, 83*d* and 83*e* are formed to be respectively communicated with the bearing holes 66 (refer to FIG. 4) of the bearing parts 65*a*, 65*b*, 65*c*, 65*d* and 65*e*.

Besides, oil jet holes 79*b*, 79*c*, 79*d* and 79*e* for a tappet (not-illustrated) constituting the valve gear of the cylinder head 40 are formed at inner parts of the second to fifth intake side supporting parts 62*b*, 62*c*, 62*d* and 62*e*.

Further, an oil passage 84*d* for shaft lubrication in a case of the cam position sensor 56 is formed at the inner part of the fourth intake side supporting part 62*d*.

The intake side camshaft 45 is provided to extend over four cylinders, and four pieces of cams 85 corresponding to the four cylinders are attached to the intake side camshaft 45 as illustrated in FIG. 3. The cam 85 is a three-dimensional cam, has a cam surface 86 (refer to FIG. 5) inclining relative to an axial direction of the intake side camshaft 45, and has a shape continuously changing a valve lift amount. In this case, the cam 85 is formed such that a cam operation angle and a lift timing also change simultaneously with a cam height, and it is set such that the cam operation angle becomes large as the valve lift amount becomes large, and further the lift timing of the valve can also be changed.

A key (not-illustrated) is intervened between the intake side camshaft 45 and the cam 85, and a relative rotation of the cam 85 relative to the intake side camshaft 45 is restricted, and the cam 85 is able to slide along the intake side camshaft 45.

The intake side camshaft 45 has a hollow structure, and a hollow inner part thereof is an oil passage 87 (FIG. 3), and right and left both end parts of the oil passage 87 are each plugged by plugs 88 as illustrated in FIG. 3. Besides, cam oil holes 89 are each bored at the intake side camshaft 45 in a radial direction corresponding to attached positions of the cams 85.

Another oil hole 31 is bored at one end part of the intake side camshaft 45, and a camshaft ring 32 is fitted to the intake side camshaft 45 to correspond to the oil hole 31 as illustrated in FIG. 3 to FIG. 5. A camshaft ring oil hole 33 is bored at the camshaft ring 32 so as to match with the oil hole 31, and an annular ring oil groove 34 is formed to be communicated with the camshaft ring oil hole 33 at an outer peripheral surface of the camshaft ring 32. Besides, an abutting surface to prevent rotation is formed at a coupling surface of a head cover of the camshaft ring 32.

Note that the camshaft ring 32 is not necessarily to be provided, and when the camshaft ring 32 is not provided, the ring oil groove 34 is formed at the outer peripheral surface of the intake side camshaft 45.

An oil supply ring 35 is loosely fitted at an outer periphery of the camshaft ring 32, and an upper half part 35*a* of the oil supply ring 35 is engaged with an annular groove part 36 formed at an upward concave part 63 of the intake side cam housing 60.

A small diameter part 37 cut out in an arc shape is formed at the upper half part 35*a* of the oil supply ring 35. An oil path 38 in an arc shape is formed between an outer peripheral surface of the small diameter part 37 and an inner peripheral surface of the annular groove part 36, and this oil path 38 constitutes a part of the oil passage 83*a* of the first intake side supporting part 62*a*. Besides, oil supply ring oil holes 39 are formed in a radial direction of the oil supply ring 35 to make the oil path 38 communicate with the camshaft ring oil groove 34. Note that the two pieces of oil supply ring oil holes 39 are illustrated in FIG. 4, but it may be provided one piece or three pieces or more.

A lower half part 35*b* of the oil supply ring 35 has a semicircular shape with a further smaller diameter than the small diameter part 37 of the upper half part 35*a*, is engaged with the cylinder head 40, and thereby, a rotation of the oil supply ring 35 is restricted. Besides, a clearance 99 is formed between an outer peripheral surface of the oil supply ring 35 and the inner peripheral surface of the annular groove part 36 of the intake side cam housing 60.

The four pieces of cam forks 94 corresponding to the respective cams 85 are supported by the fork shaft 90, and the cam forks 94 are provided to be slidable in an axial direction thereof and integral with the fork shaft 90. The cam forks 94 extend toward the intake side camshaft 45 side in a direction orthogonal to the fork shaft 90, and tip parts 94*a*, 94*b* of the cam fork 94 are formed in a bifurcated state in the axial direction.

As illustrated in FIG. 5, a rolling bearing 96 is attached to an end part 95 of the cam 85 at a side of which cam height is low (low lift side) at a space with the cam fork 94. The tip part 94*a* of the cam fork 94 at the cam surface 86 side is in contact with an end face of the rolling bearing 96 at the cam surface 86 side, and it is formed such that a part thereof overlaps with the low lift side of the cam surface 86.

A bearing ring 97 is attached at an outside in a radial direction of the rolling bearing 96 via a C-ring 98, and the tip part 94*b* of the cam form 94 at an opposite side of the cam surface is in contact with an end face of the bearing ring 97 at the opposite side of the cam surface.

Each of the cams 85 thereby slides along the intake side camshaft 45 linking with or in synchronization with the sliding of the fork shaft 90 in the axial direction.

Note that a basic constitution around the exhaust side camshaft 46 is similar to the above-stated constitution around the intake side camshaft 45, and therefore, the detailed description of the constitution thereof is not given.

In the engine 2 having the above-stated constitution, an accelerator is operated, then the motor 93 is activated, and the fork shaft 90 slides and moves for a desired amount in the axial direction by the rotation of the output shaft of the motor 93 via the ball screw 91 and the gear group 92. The cam forks 94 slide in the axial direction of the fork shaft 90 in the respective cylinders in accordance with the sliding operation of the fork shaft 90, and the cams 85 thereby each slide along the intake side camshaft 45. The valve lift amount and the operation angle are continuously and variably controlled in accordance with the accelerator opening angle. An amount of air intake and exhaust is suitably controlled from an idling rotation range to a full opening range, and the most suitable air intake and exhaust for an engine speed (or a vehicle speed) is performed.

At this time, the lubricant oil from the cylinder head 40 is supplied from the inlet part 81 to the respective bearing holes 66 of the bearing parts 65*a*, 65*b*, 65*c*, 65*d* and 65*e* via the main oil passage 80, the oil communication passages 82*a*, 82*b*, 82*c*, 82*d* and 82*e*, and the oil passages 83*a*, 83*b*, 83*c*, 83*d* and 83*e* of the first to fifth intake side supporting parts 62*a*, 62*b*, 62*c*, 62*d* and 62*e*.

Besides, the lubricant oil is supplied between the intake side camshaft 45 and each cam 85 via the arc-shaped oil path 38 of the oil passage 83*a* of the first intake side supporting part 62*a*, the oil supply ring oil hole 39, the ring oil groove 34, the camshaft ring oil hole 33, the oil hole 31 of the intake side camshaft 45, the oil passage 87, and the respective cam oil holes 89.

Further, the lubricant oil is supplied to the tappet constituting the valve gear of the cylinder head 40 via the oil jet holes 79*b*, 79*c*, 79*d* and 79*e* at inner parts of the second to fifth intake side supporting parts 62*b*, 62*c*, 62*d* and 62*e*, and the lubricant oil is supplied to the shaft in the case of the cam position sensor 56 via the oil passage 84*d* at an inner part of the fourth intake side supporting part 62*d*.

As stated above, the lubricant oil is easily and surely supplied to the mechanisms to drive the intake side camshaft 45 and the cams 85.

According to the cam housing structure for the three-dimensional cam of the present embodiment, the third intake side supporting part 62*c* is coupled to the two exhaust side supporting parts of the second and third exhaust side supporting parts 72*b*, 72*c* via the second reinforcing member 77*b* and the third reinforcing member 77*c*, and therefore, it is possible to enough increase stiffness and strength for a force acted in a tilting direction of the intake side supporting parts and the exhaust side supporting parts toward the intake side camshaft 45 side or the exhaust side camshaft 46 side.

Besides, the first to fourth reinforcing members 77*a*, 77*b*, 77*c* and 77*d* are stretched over between the intake side fixing part and the exhaust side fixing part in an opposite side diagonal direction from the adjacent reinforcing member from one another to form a truss, and therefore, it is possible to improve stiffness relative to bending at the operation time of the cam fork 94.

Besides, the bearing parts 65*a*, 65*b*, 65*c*, 65*d* and 65*e* rotatably supporting the fork shaft 90 are formed at upward of the intake side supporting parts 62*a*, 62*b*, 62*c*, 62*d* and 62*e*, and therefore, it is possible to increase positional accuracy of a bearing bore diameter center of the intake side camshaft 45 and a bearing bore diameter center of the fork shaft 90.

Besides, the bearing parts 65*a*, 65*b*, 65*c*, 65*d* and 65*e* are provided at upward of the intake side supporting parts 62*a*, 62*b*, 62*c*, 62*d* and 62*e*, and thereby, the height of the intake side cam housing 60 becomes high. Accordingly, a moment generated by forces in a camshaft direction, a longitudinal direction, or a rotational direction acting on the bearing parts 65*a*, 65*b*, 65*c*, 65*d* and 65*e* becomes large, but it is possible to secure the stiffness and strength capable of enough staying with the moment according to the cam housing structure for the three-dimensional cam of the present embodiment.

Besides, it is possible to enough receive a force acting on the tilting direction of the intake side supporting parts or the exhaust side supporting parts toward the intake side camshaft 45 side or the exhaust side camshaft 46 side, and to improve the stiffness and strength of the cam housing owing to the intake side cam housing 60 mutually and integrally coupling the plural intake side supporting parts 62*a*, 62*b*, 62*c*, 62*d* and 62*e* and the exhaust side cam housing 61 mutually and integrally coupling the plural exhaust side supporting parts 63*a*, 63*b*, 63*c*, 63*d* and 63*e*.

Further, the opening part 64 is formed at the intake side cam housing 60, and thereby, it is disadvantageous in the stiffness and strength as it is. However, it is possible to secure the stiffness and strength at the cam housing capable of enough staying with the moment according to the cam housing structure for the three-dimensional cam of the present embodiment.

Besides, the driving mechanism of the fork shaft 90 is attached at the upper part of the intake side cam housing 60, and thereby, it is possible to improve assembling accuracy compared to a case when the driving mechanism is separated. Further, it is possible to use the driving mechanism in itself as a rigid member, and therefore, it is possible to further increase the stiffness and strength.

Besides, the driving mechanism of the fork shaft 90 is allocated at a position opposite to the fork shaft 90 sandwiching the intake side camshaft 45 in a plan view, and thereby, it is possible to attach the engine 2 in a good balance.

Besides, the oil communication passages 82*a*, 82*b*, 82*c*, 82*d* and 82*e* are respectively formed at the inner parts of of the coupling members 78*a*, 78*b*, 78*c*, 78*d* and 78*e* mutually coupling the intake side cam housing 60 and the exhaust side cam housing 61, and thereby, it is possible to further improve the stiffness and strength of the cam housing.

Besides, the oil supply ring 35 is provided between the intake side camshaft 45 and the intake side supporting part 62*a*, the oil path 38 constituting a part of the oil passage 83*a* at the inner part of the intake side cam housing 45 is formed between the outer peripheral surface of the oil supply ring 35 and the inner peripheral surface of the intake side supporting part 62*a*, and the oil passage 83*a* is communicated with the bearing hole 66 of the bearing part 65*a* of the fork shaft 90, and thereby, it is possible to easily manufacture an oil passage reaching the bearing part 65*a* without damaging the stiffness and strength of the intake side cam housing 60 by processing the oil passage at the intake side cam housing 60 by using a drill and so on, and it is possible to form the oil passage as short as possible.

Besides, the oil holes 31, 33, 39 heading from the oil path 38 to the inner part of the intake side camshaft 45 are formed in the radial direction at the oil supply ring 35 and the intake side camshaft 45, and therefore, it is possible to easily and surely perform not only the supply of the oil for the fork shaft 90 but also the supply of the oil for the intake side camshaft 45.

Besides, the oil path 38 is formed by cutting out the outer peripheral part of the oil supply ring 35 in the arc shape, and thereby, it is possible to make a flow of the oil heading for the fork shaft 90 smooth.

Note that in the description of the above-stated embodiment, the case when the third intake side supporting part 62*c* is coupled to the two exhaust side supporting parts of the second and third exhaust side supporting parts 72*b*, 72*c* via the second reinforcing member 77*b* and the third reinforcing member 77*c* is exemplified to be described, but the present embodiment is not limited thereto, and various changes may possible as long as any one of the supporting parts of the intake side supporting parts or the exhaust side supporting parts is coupled to two or more of the other supporting parts via the reinforcing members.

Besides, all of the components in the embodiments can be appropriately replaced by existing components and so on, and various variations including a combination with the other existing components are possible, the present embodiments are to be considered in all respects as no restrictive.

According to the present embodiment, various excellent effects can be obtained such that it is possible to enough increase stiffness and strength of a cam housing and to easily supply lubricant oil for a camshaft and a cam driving mechanism.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A cam housing structure for a three-dimensional cam, comprising:

a cam housing supporting an intake side camshaft and an exhaust side camshaft;

plural intake side supporting parts of the cam housing rotatably supporting the intake side camshaft from above;

plural exhaust side supporting parts of the cam housing rotatably supporting the exhaust side camshaft from above at an upper part of a cylinder head;

bearing parts rotatably supporting a fork shaft having cam forks sliding and driving three-dimensional cams along the intake side camshaft at upward of the intake side supporting parts, an intake side cam housing mutually and integrally coupling the plural intake side supporting parts;

an opening part formed at the intake side cam housing in a sliding range of the cam forks; and a driving mechanism driving the fork shaft and attached to the intake side supporting parts of the intake side cam housing at an opposite position of the fork shaft and sandwiching the intake side camshaft in plan view, wherein any one of the supporting parts of the intake side supporting parts or the exhaust side supporting parts is coupled to two or more pieces of the other supporting parts, of at least one of the exhaust side supporting parts and the intake side supporting parts respectively, via reinforcing members.

2. The cam housing structure for the three-dimensional cam according to claim 1, wherein the one supporting part is disposed between two pieces of the other supporting parts in an axial direction of the intake side camshaft or the exhaust side camshaft, and is coupled to the two pieces of the other supporting parts via the reinforcing members.

3. The cam housing structure for the three-dimensional cam according to claim 1, further comprising:

an exhaust side cam housing mutually and integrally coupling the plural exhaust side supporting parts.

4. The cam housing structure for the three-dimensional cam according to claim 1, further comprising:

an intake side cam housing mutually and integrally coupling the plural intake side supporting parts; and an exhaust side cam housing mutually and integrally coupling the plural exhaust side supporting parts, are coupled with each other via coupling members, wherein the cam housing structure for the three-dimensional cam further comprising:

oil passages each formed at an inner part of the intake side cam housing and an inner part of the exhaust side cam housing; and oil communication passages communicating the oil passages of the intake side cam housing with the oil passage of the exhaust side cam housing formed at inner parts of the coupling members.

5. The cam housing structure for the three-dimensional cam according to claim 4, further comprising:

an oil supply ring between the intake side camshaft and the intake side supporting part; and an oil path constituting a part of the oil passage at the inner part of the intake side cam housing formed between an outer peripheral surface of the oil supply ring and an inner peripheral surface of the intake side supporting part, wherein the oil passages are communicated with bearing parts rotatably supporting a fork shaft formed at upward of the intake side supporting parts.

6. The cam housing structure for the three-dimensional cam according to claim 5, further comprising:

oil holes heading from the oil path to an inner part of the intake side camshaft formed at the oil supply ring and the intake side camshaft in a radial direction.

7. The cam housing structure for the three-dimensional cam according to claim 5, wherein the oil path is formed by cutting out an outer peripheral part of the oil supply ring in an arc shape.

8. The cam housing structure for the three-dimensional cam according to claim 1, wherein the driving mechanism comprises:

a motor;

a ball screw connected to the motor; and a gear group engaging the ball screw and the fork shaft.

9. The cam housing structure for the three-dimensional cam according to claim 1, wherein the driving mechanism is disposed on a rear side of the intake side cam housing in reference to the vehicle in which the cam housing structure is disposed.

* * * * *